US008915570B2

(12) United States Patent
Nishida

(10) Patent No.: US 8,915,570 B2
(45) Date of Patent: Dec. 23, 2014

(54) INKJET DEVICE AND SEALING METHOD FOR THE INKJET DEVICE

(75) Inventor: Hideaki Nishida, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 638 days.

(21) Appl. No.: 13/232,860

(22) Filed: Sep. 14, 2011

(65) Prior Publication Data

US 2012/0147088 A1 Jun. 14, 2012

(30) Foreign Application Priority Data

Dec. 10, 2010 (JP) ..... 2010-275897

(51) Int. Cl.
*B41J 2/14* (2006.01)
*B41J 2/175* (2006.01)

(52) U.S. Cl.
CPC ..... *B41J 2/14* (2013.01); *B41J 2/17553* (2013.01); *B41J 2/17533* (2013.01)
USPC ..... 347/20

(58) Field of Classification Search
USPC ..... 347/20
See application file for complete search history.

(56) References Cited

U.S. PATENT DOCUMENTS

2001/0043247 A1* 11/2001 Tajima et al. ..... 347/20
2008/0079782 A1* 4/2008 Taira ..... 347/65
2009/0295882 A1* 12/2009 Hagiwara ..... 347/85
2011/0242194 A1* 10/2011 Hotta et al. ..... 347/20

FOREIGN PATENT DOCUMENTS

JP 360579 B2 8/1999
JP 2006-150870 6/2006
JP 2007-105926 4/2007
JP 2007-185868 A 7/2007

OTHER PUBLICATIONS

English Translation of Office Action filed Dec. 4, 2013 in corresponding Chinese Patent Application No. 201110268287.2.

* cited by examiner

*Primary Examiner* — Shelby Fidler
(74) *Attorney, Agent, or Firm* — Patterson & Sheridan LLP

(57) ABSTRACT

According to one embodiment, an inkjet device includes: an inkjet head; an armor section configured to surround the periphery of the inkjet head; a first gap formed over the entire periphery in the peripheral direction in a plurality of the armor sections; and a seal body for forming a surface tension seal by fluid in a second gap arranged in the first gap to form a gap narrower than the first gap.

12 Claims, 4 Drawing Sheets

INKJET DEVICE AND SEALING METHOD FOR THE INKJET DEVICE

CROSS-REFERENCE TO RELATED APPLICATION

This application is based upon and claims the benefit of priority from: Japanese Patent application No. 2010-275897, filed on Dec. 10, 2010; the entire contents of which are incorporated herein by reference.

FIELD

Embodiments described herein relate generally to a sealing technique for protecting a wiring member and the like of an inkjet head.

BACKGROUND

An inkjet device used in an inkjet recording apparatus includes an inkjet head, a head attaching member for attaching the inkjet head to the inkjet recording apparatus, a circuit board connected to an electrode of the inkjet head via a flexible wiring board or the like, and armor members that cover the inkjet head and the circuit board.

In the inkjet device, the inkjet head is adjusted to be positioned with respect to the head attaching member and fixed to the head attaching member to arrange a nozzle plate and a printing surface at a predetermined interval.

As the armor members, the inkjet device includes, for example, a head cover (a mask plate) arranged around the inkjet head and a cover member that covers the circuit board and the head attaching member.

In the inkjet head having such a configuration, in order to prevent ink leaking during replacement of an ink bottle or the like from trickling down the outer surfaces of the armor members and intruding into the inside of the inkjet head from a gap between the mask plate and the inkjet head or a gap of the armor members, a seal structure for, for example, filling a seal material in the gap or inserting a gasket into the gap is adopted.

DETAILED DESCRIPTION

In general, according to one embodiment, an inkjet device includes: an inkjet head; an armor section configured to surround the periphery of the inkjet head; a first gap formed over the entire periphery in the peripheral direction in a plurality of the armor sections; and a seal body for forming a surface tension seal by fluid in a second gap arranged in the first gap to form a gap narrower than the first gap.

First Embodiment

First, a first embodiment is explained with reference to the drawings.

Figure 1:
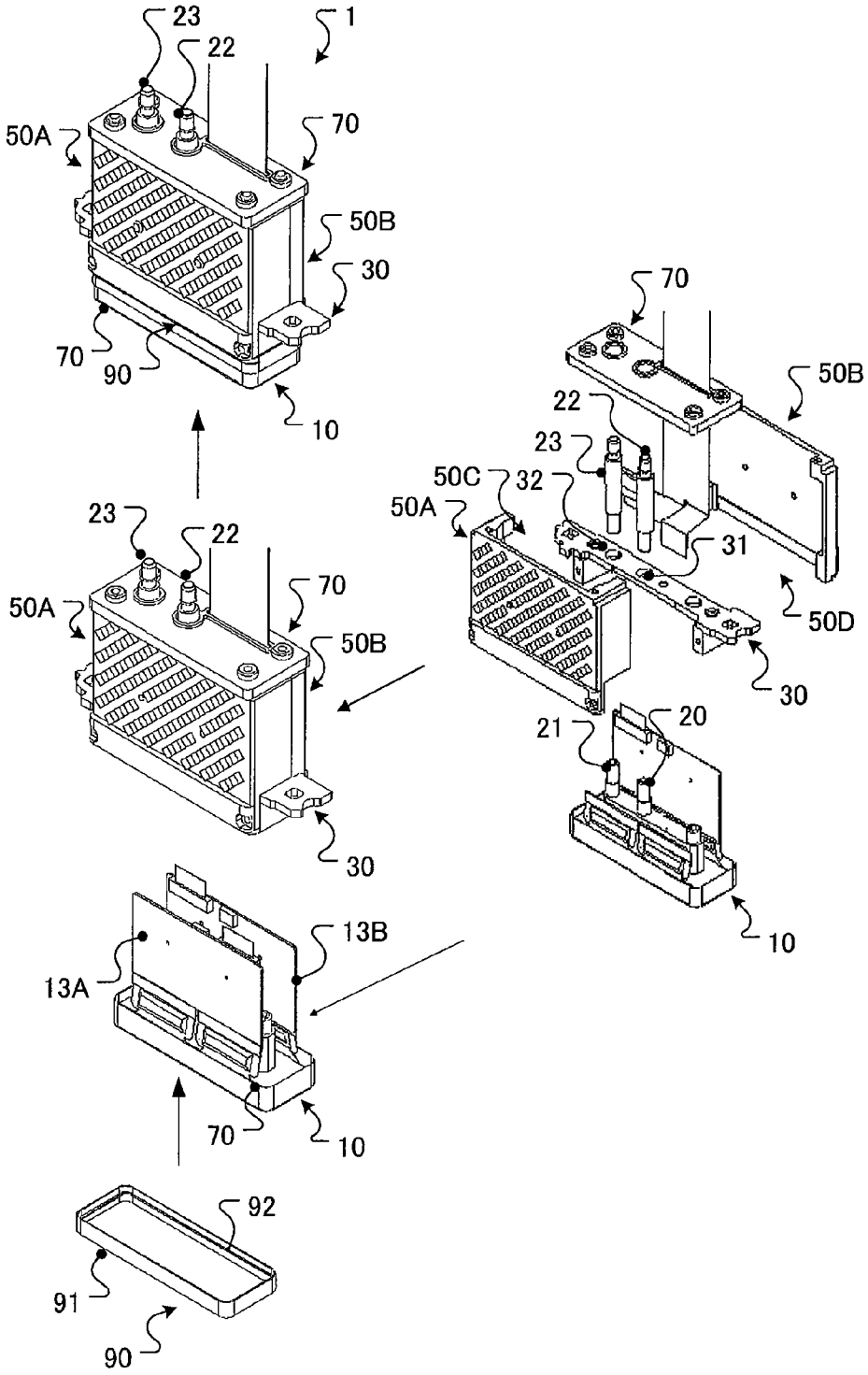
FIG. 1 is a diagram for explaining an assembly process for an inkjet device according to a first embodiment.
Figure 2:
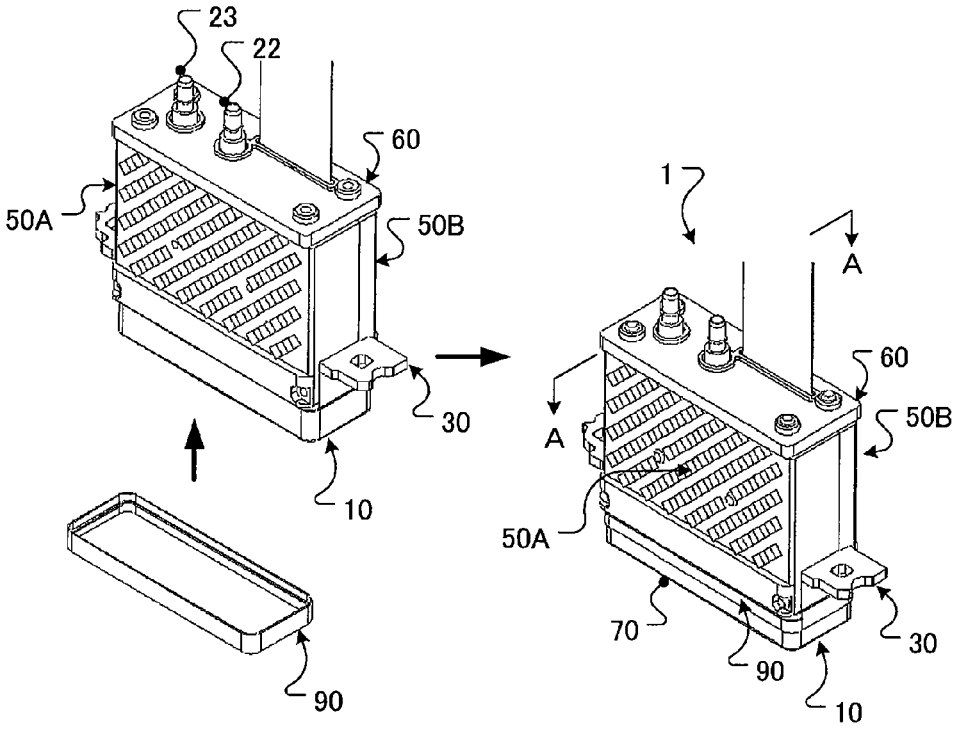
FIG. 2 is a diagram for explaining an inserting procedure for a seal body in the first embodiment.
Figure 3:
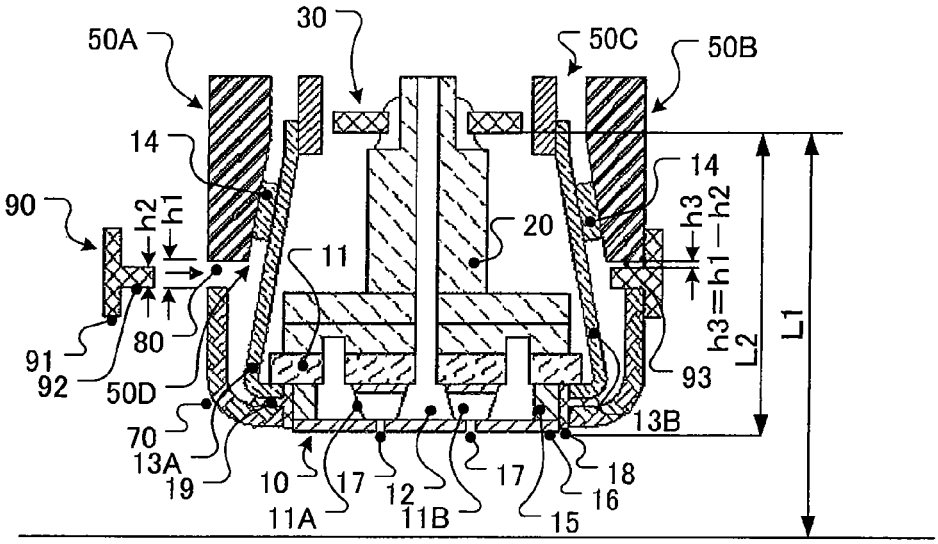
FIG. 3 is an A-A arrow view of FIG. 2.

FIG. 1 is a diagram for explaining an assembly process for an inkjet device according to the first embodiment. FIG. 2 is a diagram for explaining an inserting procedure for a seal body in the first embodiment. FIG. 3 is an A-A arrow view of FIG. 2.

In FIGS. 1 to 3, an inkjet device 1 includes an inkjet head 10, a head attaching member 30 for attaching the inkjet head 10 to make it possible to adjust the position of the inkjet head 10; and a pair of opposed side covers 50A and 50B forming armor members attached to the head attaching member 30 by screws or the like.

In a state in which the pair of side covers 50A and 50B are attached to the head attaching member 30, an upper opening 50C is formed in an upper part of the pair of side covers 50A and 50B and a lower opening 50D is formed in a lower part of the pair of side covers 50A and 50B. The head attaching member 30 is attached to a not-shown inkjet recording apparatus to be adjustable in, for example, up-down, front-back, and left-right directions. The head attaching member 30 is adjusted to set a distance between the head attaching member 30 and a print sheet to L1.

The inkjet device 1 includes a top cover 60 forming an armor member that closes the upper opening 50C and attached to upper end faces of the pair of side covers 50A and 50B by screws or the like.

The inkjet device 1 further includes a substantially parallelepiped mask plate 70 opposed to the lower opening 50D and covering an ink ejection surface side of the inkjet head 10. As shown in FIG. 3, a large gap 80 having a height h1, which is a first gap, is provided between an opened end face of the mask plate 70 and lower end opened end faces of the pair of side covers 50A and 50B.

The inkjet head 10 according to this embodiment is an ink circulation type. As shown in FIG. 3, two actuator rows 11A and 11B made of a piezoelectric member, a longitudinal direction of which is a front-back direction, are provided in parallel on the lower surface of a substrate 11. In a latitudinal direction orthogonal to the longitudinal direction of the actuator rows 11A and 11B, plural grooves are formed at a fixed interval along the longitudinal direction. The grooves are formed as pressure chambers 12. Electrodes (not shown) are formed on inner peripheral surfaces of the grooves. The electrodes are connected to flexible circuit boards 13A and 13B, which are arranged on both sides in the latitudinal direction of the substrate 11, via a wiring pattern (not shown) formed on the surface of the substrate 11. For example, the flexible circuit boards 13A and 13B are bent to face driving ICs 14 to the outer side and arranged to be faced upward.

A frame member 15 is arranged around the substrate 11. A nozzle plate 16 is fixed to the frame member 15 by an adhesive. Nozzles 17 corresponding to the respective pressure chambers 12 are formed in the nozzle plate 16. A mask seal member 18 formed in a rectangular frame shape and having insulating properties is bonded to the outer periphery of the frame member 15. A partition piece 19 is formed on the outer peripheral surface of the mask seal member 18 to cover a connecting section on a proximal end side of the flexible circuit boards 13A and 13B. A lower end side opening of the mask plate 70 is pushed in until coming into contact with the partition piece 19 and is fit in the partition piece 19. The mask plate 70 is fixed to the mask seal member 18 by an adhesive.

In the inkjet head 10, an ink supply pipe 20 and an ink discharge pipe 21 are vertically provided to face upward on the upper surface side of the substrate 11. In the head attaching member 30 formed in a flat plate shape, a first through-hole 31 and a second through-hole 32, through which the ink supply pipe 20 and the ink discharge pipe 21 are respectively inserted, are formed. In order to make it possible to adjust, for example, a distance L2 between the nozzle plate 16 of the inkjet head 10 and the head attaching member 30, the ink supply pipe 20 inserted through the first through-hole 31 and the ink discharge pipe 21 inserted through the second through-hole 32 are bonded and fixed by filling an adhesive in the first through-hole 31 and the second through-hole 32 after the positions of the ink supply pipe 20 and the ink discharge pipe 21 are adjusted. The upper end of the ink supply pipe 20 and the upper end of the ink discharge pipe 21 are respectively coupled to coupling pipes 22 and 23. Ink is circulated between a not-shown ink supply section and the inkjet head 10 via the coupling pipes 22 and 23.

In this embodiment, in the inkjet device 1, a band-like seal body 90 formed in a rectangular frame shape is inserted to cover the large gap 80 from the outer peripheral surface side of the pair of side covers 50A and 50B and the mask plate 70 to correspond to the periphery of the large gap 80. As shown in FIG. 2, the seal body 90 is inserted into the large gap 80 through the mask plate 70 from an ink ejection surface side of the inkjet head 10.

The seal body 90 is formed of rubber having elasticity, for example, fluorine rubber. An inserting piece section 92 projecting to the inner side and inserted into the large gap 80 is integrally formed on the inner peripheral surface of a band-like seal main body 91 formed in a rectangular frame shape. The seal body 90 is inserted to be tightened between the outer peripheral surfaces of the pair of side covers 50A and 50B and the mask plate 70. As shown in FIG. 3, a thickness h2 of the inserting piece section 92 is set smaller than the height h1 of the large gap 80. The inserting piece section 92 is inserted to come into contact with an opened end face of the mask plate 70.

Therefore, a small gap 93 having a height h3 (h3=h1-h2), which is a second gap, is formed between the inserting piece section 92 and the lower end faces of the pair of side covers 50A and 50B.

In an inkjet recording apparatus including the inkjet device having the configuration explained above, ink is not filled at a stage of shipment from a factory. The inkjet recording apparatus is transported in a state in which the small gap 93 is maintained.

Even if the seal main body 91 is inserted into the outer peripheral surfaces of the pair of side covers 50A and 50B and the mask plate 70 with tightening force, ink trickling down the surfaces of the side covers 50A and 50B soaks into a space between the side covers 50A and 50B and the mask plate 70 because of mechanical finishing accuracy such as surface accuracy. The soaking ink is led into the small gap 93.

The height h3 of the ink led into the small gap 93 is set to a height at which a seal film due to surface tension can be formed by the soaking ink between the inserting piece section 92 forming the small gap 93 and the lower end faces of the side covers 50A and 50B. If the seal film due to surface tension of the ink is formed in the small gap 93, the ink trickling down the surfaces of the side covers 50A and 50B is prevented from intruding into the inside of the inkjet device 1 through the small gap 93 by the seal film.

In this embodiment, the small gap 93 is a mere air gap during shipment of the inkjet recording apparatus mounted with the inkjet device 1 from the factory. Even if vibration during transportation is applied to the inkjet device 1 in this state, the inserting piece section 92 of the seal body 90 does not come into contact with the lower end faces of the side covers 50A and 50B. If the small gap 93 is not present and the entire large gap 80 is filled with the inserting piece section 92, it is conceivable that the vibration is directly transmitted from the side covers 50A and 50B to the inserting piece section 92, the mask plate 70 is pushed, and the height of the large gap 80 is increased. If the height of the large gap 80 is increased, it is likely that the distance L2 adjusted during the shipment from the factory deviates.

On the other hand, in this embodiment, the small gap 93 of the inkjet device 1 is maintained in an air gap state from the shipment from the factory until delivery to a user. When ink is filled for the first time when the use of the inkjet device 1 is started or when an ink bottle or the like is replaced, leaking ink trickles down the outer surfaces of the coupling pipes 22 and 23, drips down the outer surfaces of the side covers 50A and 50B, and intrudes into the small gap 93. If the ink intrudes into the small gap 93 over the entire periphery of the small gap 93, an intruding ink portion contracts to reduce the width thereof with surface tension to change to a spherical shape. The upper surface of the ink changed to a semispherical shape comes into contact with the lower end faces of the side covers 50A and 50B and a surface tension seal is completed.

In the inkjet device 1, the side covers 50A and 50B are attached to the head attaching member 30 and the top cover 60 is attached to the side covers 50A and 50B. Therefore, gaps are formed among these members according to component accuracies of the members. The size of the gaps is small and fluctuation of the gaps is also small. The top cover 60 is formed to overlap the side covers 50A and 50B. If the ink flows down to the upper surface of the top cover 60 through the outer peripheral surfaces of the coupling pipes 22 and 23, for example, during replacement of the ink bottle and the ink drips from the top cover 60, the ink dripping through the space between the side covers 50A and 50B and the outer surfaces of the side covers 50A and 50B is moved in the gravity direction. Fluctuation in the gap (the large gap 80) between the side covers 50A and 50B and the mask plate 70 is large. Naturally, the height h1 of the large gap 80 has to be increased.

Even if a surface tension seal is completed in the large gap 80 by the ink moved by the gravity, the surface tension is weak because the height h1 of the large gap 80 is large. Therefore, the surface tension cannot sufficiently resist the pressure of the ink moved by the gravity and the ink intrudes into the inside of the head.

However, since the small gap 93 narrower than the height h1 of the large gap 80 is formed by the inserting piece section 92 of the seal body 90, it is possible to form a surface tension seal having a surface tension larger than the surface tension of the surface tension seal formed in the large gap 80. It is possible to obtain a surface tension seal that can overcome the pressure of the ink moved from the outside by the gravity and prevent the ink from intruding into the inside.

If the height h3 of the small gap 93 is a height at which the upper surface of the ink comes into contact with the lower end faces of the side covers 50A and 50B before the intruding ink portion is changed to the semispherical shape by the surface tension, the surface tension seal is not completed. If the height h3 is a height at which the upper surface of the ink does not come into contact with the lower end faces of the side covers 50A and 50B even if the intruding ink portion is changed to the semispherical shape by the surface tension, the surface tension seal is not completed.

Second Embodiment

Figure 4:
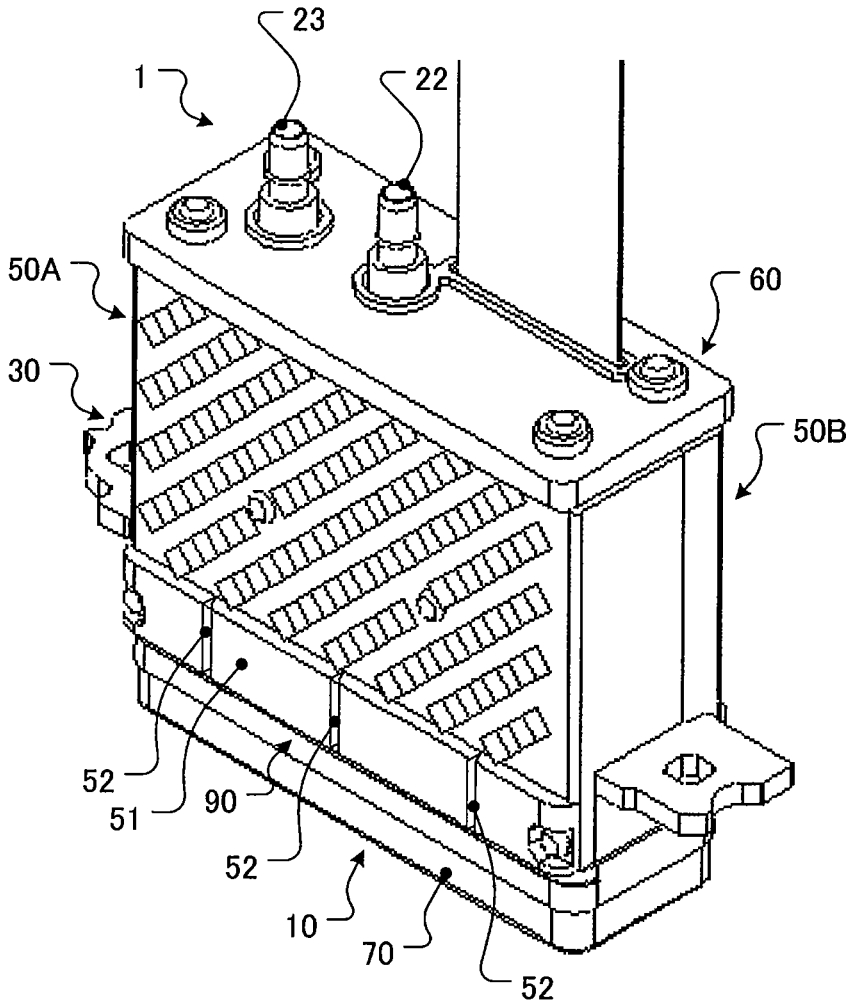
FIG. 4 is an external perspective view of an inkjet device according to a second embodiment.

FIG. 4 is an external perspective view of an inkjet device according to a second embodiment.

In this embodiment, vertical grooves 52 are formed at an appropriate interval in cover lower sections 51 of the side cover 50A and the side cover 50B. There is a level difference between the cover lower sections 51 and upper sections of the side cover 50A and the side cover 50B. Ink trickling down the outer surfaces of the side cover 50A and the side cover 50B is collected in the vertical grooves 52 via the level difference or directly. The ink is led to the small gap 93 through adhering surfaces of the seal main body 91 and the cover lower sections 51.

Therefore, it is possible to collect, without waste, leaking ink required for completing a surface tension seal over the entire periphery of the small gap 93. It is possible to complete the surface tension seal at an early stage after the use of an inkjet recording apparatus is started.

According to the embodiments, the seal body 90 maintains the small gap 93 in the air gap state and does not play the function of a fluid tight seal from the shipment from the factory, during which the sealing property of the inkjet device 1 is unnecessary, until the delivery to the user. This makes it possible to prevent the distance L2 between the nozzle attaching member 30 and the nozzle plate 16 from changing even if the inkjet device 1 is affected by external vibration or the like, for example, during the transportation. After the use of the inkjet recording apparatus is started, the surface tension seal is formed in the small gap 93 using the ink leaking, for example, during replacement work for the ink bottle. This makes it possible to prevent the ink from intruding into the inkjet device 1.

In the embodiments, the surface tension seal is formed by the leaking ink. However, ink or nonconductive fluid such as oil or pure water prepared in advance may be dripped to the adhering surfaces of the seal body 90 and the side covers 50A and 50B or the vertical grooves 52 shown in FIG. 4. In this case, the surface tension seal can be completed when the inkjet recording apparatus is used first. If the nonconductive fluid is used, when the seal body 90 is removed, for example, during disassembly of the inkjet device 1, a problem such as short-circuit does not occur even if the nonconductive fluid forming the surface tension seal scatters to the flexible circuit boards 13A and 13B by mistake.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. An inkjet device comprising:

an inkjet head having an outer surface and an ink election surface;

a cover section surrounding the outer surface of the inkjet head;

a housing section positioned at an upper side of the cover section and surrounding the outer surface of the inkjet head, a first gap extending between the cover and the housing section; and a seal body arranged in the first gap to form a second gap narrower than the first gap, a surface tension seal formable with the presence of fluid in the second gap;

wherein a vertical groove is formed on an outer surface of the housing section so that, in a use state in which the inkjet head is used face down, ink moved by gravity is lead through the vertical groove to the second gap.

2. The device according to claim 1, wherein the first gap is formed between end faces of the cover section and the housing section.

3. The device according to claim 1, wherein the seal body includes an endless seal main body that comes into contact with, across the first gap, an outer surface of the cover section and an outer surface of the housing section, and an inserting piece section that projects from an inner surface side of the seal main body to an inner side and is positioned in the first gap.

4. The device according to claim 1, further comprising a circuit board connected to the inkjet head, wherein the circuit board is arranged on an inner side of the cover section and an inner side of the housing section.

5. The device according to claim 1, further comprising a head attaching member for bonding and fixing the inkjet head and attaching the device to an inkjet recording apparatus.

6. An inkjet device comprising:

an inkjet head having an outer surface and an ink ejection surface;

a cover section surrounding the outer surface of the inkjet head;

a housing section positioned at the upper side of the cover section and surrounding an outer surface of the inkjet head, a first gap extending between the cover section and the housing section; and a seal body arranged in the first gap to form a second gap narrower than the first gap, the seal body having a T-shaped cross-section, and a surface tension seal formable with the presence of fluid in the second gap;

wherein a vertical groove is formed on an outer surface of the housing section so that, in a use state in which the inkjet head is used face down, ink moved by gravity lead through the vertical groove to the second gap.

7. The device according to claim 6, wherein the seal body includes an inserting piece section which is inserted into the first gap, the thickness of the inserting piece section having a height smaller than a height of the first gap.

8. The device according to claim 6, wherein the first gap is farmed between end faces of the cover section and the housing section.

9. The device according to claim 6, wherein the seal body includes an endless seal main body contacting, across the first gap, an outer surface of the cover section and an outer surface of the housing section, and an inserting piece section that projects from an inner surface side of the seal main body and is positioned in the first gap.

10. The device according to claim 6, further comprising a circuit board connected to the inkjet head, wherein the circuit board is arranged on an inner side of the cover section and an inner side of the housing section.

11. The device according to claim 6, further comprising a head attaching member for bonding and fixing the inkjet head and attaching the device to an inkjet recording apparatus.

12. An inkjet device comprising:

an inkjet head;

a cover including a plurality of cover sections surrounding a periphery of the inkjet head;

a first gap formed between two of the plurality of cover sections and extending around the entire periphery of the inkjet head; and a seal body positioned in the first gap to form a second gap between the two of the plurality of cover sections, the second gap narrower than the first gap, the seal body forming a surface tension seal with the presence of fluid in the second gap, wherein a vertical groove is formed on an outer surface of the cover for leading ink moved by gravity to the second gap in a use state in which the inkjet head is used face down.

* * * * *